US006390187B1

(12) United States Patent
Marechal et al.

(10) Patent No.: US 6,390,187 B1
(45) Date of Patent: May 21, 2002

(54) HEAT EXCHANGER WITH FLEXIBLE TUBES

(75) Inventors: Laurence Marechal, Versailles; Carlos Martins, Montfort l'Amaury, both of (FR)

(73) Assignee: Valeo Thermique Moteur, La Verriere (FR)

( * ) Notice: Subject to any disclaimer, the term of this patent is extended or adjusted under 35 U.S.C. 154(b) by 0 days.

(21) Appl. No.: 09/623,212

(22) PCT Filed: Dec. 23, 1999

(86) PCT No.: PCT/FR99/03277

§ 371 Date: Mar. 7, 2001

§ 102(e) Date: Mar. 7, 2001

(87) PCT Pub. No.: WO00/39517

PCT Pub. Date: Jul. 6, 2000

(30) Foreign Application Priority Data

Dec. 29, 1998 (FR) ..... 98 16560
May 17, 1999 (FR) ..... 99 06223

(51) Int. Cl.[7] ..... F28F 1/10; F28D 1/00
(52) U.S. Cl. ..... 165/172; 165/148
(58) Field of Search ..... 165/46, 172, 177, 165/148, 178, 173, 81, 171, DIG. 454, DIG. 455, DIG. 459, DIG. 460, DIG. 471; 210/640

(56) References Cited

U.S. PATENT DOCUMENTS

| | | | | | |
|---|---|---|---|---|---|
| 824,493 | A | * | 6/1906 | Livingston | 165/153 |
| 1,302,111 | A | * | 4/1919 | Wilder | 165/148 |
| 1,399,146 | A | * | 12/1921 | Naujoks | 165/148 |
| 3,419,069 | A | * | 12/1968 | Baker et al. | 165/158 |
| 3,835,920 | A | * | 9/1974 | Mondt | 165/81 |
| 4,271,900 | A | * | 6/1981 | Reitz | 165/162 |
| 4,589,481 | A | * | 5/1986 | Mansson | 165/910 |
| 4,846,977 | A | * | 7/1989 | DeVellis et al. | 210/640 |
| 5,538,079 | A | * | 7/1996 | Pawlick | 165/153 |
| 6,119,769 | A | * | 12/2000 | Yu et al. | 165/109.1 |

* cited by examiner

*Primary Examiner*—Henry Bennett
*Assistant Examiner*—Tho V Duong
(74) *Attorney, Agent, or Firm*—Liniak, Berenato, Longacre & White

(57) ABSTRACT

A heat exchanger (2) with flexible tubes (20), particularly for a motor vehicle cooling installation. The tubes (20), for example made of a plastic material, are designed to carry a heat-exchanging fluid capable of co-operating with an air stream circulating through the exchanger (2). The inventive exchanger (2) comprises means for maintaining the tubes (20) in parallel rows. The tubes (20) are designed to be generally shaped like substantially sinusoidal lines. The sinusoids of two contacting tubes (211, 212) of two consecutive rows, are phase offset relatively to each other such that the two tubes (211, 212) are maintained in two contact zones (210) per sinusoid interval, thereby leaving interstices between the tubes (20) to enhance the penetration of the flux.

11 Claims, 2 Drawing Sheets

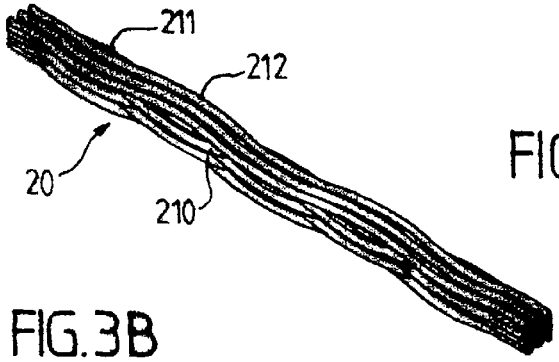
FIG. 3A
FIG. 3B
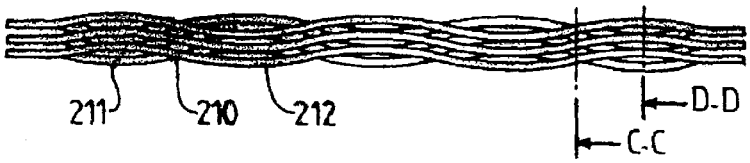
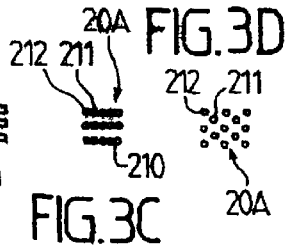
FIG. 3C
FIG. 3D
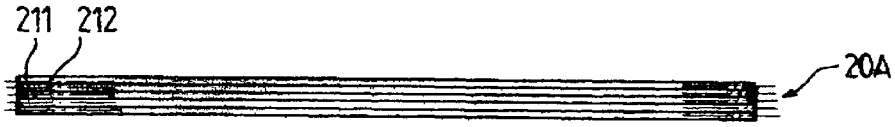
FIG. 3E
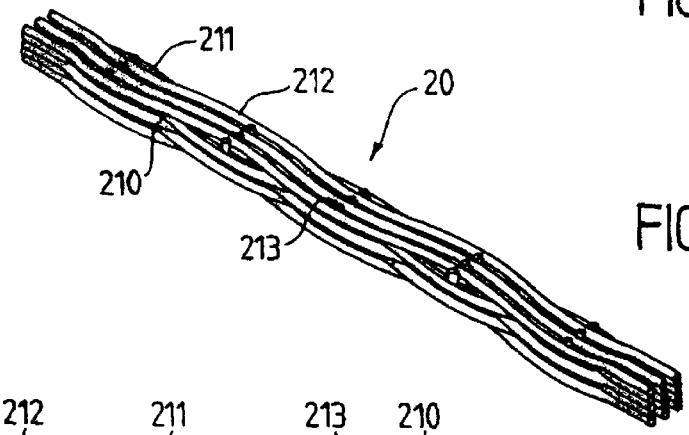
FIG. 4A
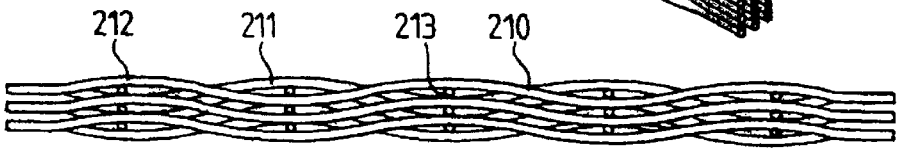
FIG. 4B
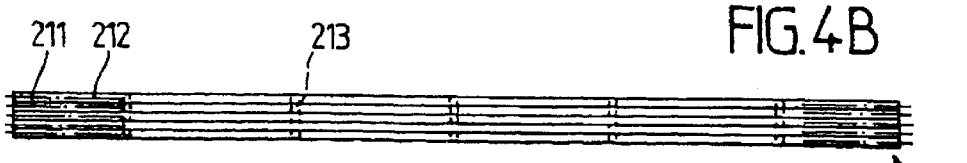
FIG. 4C

HEAT EXCHANGER WITH FLEXIBLE TUBES

BACKGROUND OF THE INVENTION

1. Field of the Invention

The present invention relates to the field of heat exchangers, especially for motor-vehicle engine cooling installations. It relates more particularly to heat exchangers with flexible tubes, produced from plastic, for example.

2. Description of Related Art

Such heat exchangers, described especially in the unpublished French patent Application No 98 04966 by the Applicant, includes tubes produced from a substance which is substantially flexible and the extremities of which communicate with at least one manifold for a heat-exchange fluid, interacting, for example, with an airflow which passes through the exchanger.

So as to increase the thermal interaction by the flow with the tubes of the exchanger, it is currently desirable to maintain interstices between the tubes, through which the airflow penetrates. Such interstices should furthermore make it possible to perturb the flow in the manner of the perturbing vanes which heat exchangers with rigid tubes usually include.

SUMMARY OF THE INVENTION

The present invention then improves on the situation.

It is concerned with a heat exchanger having flexible tubes, of the abovementioned type, which, according to one general characteristic of the invention, includes means for holding the tubes in substantially parallel rows. The tubes are shaped so as to exhibit general shapes of substantially sinusoidal lines. The sinusoids of two tubes in contact, of two respective consecutive rows, are substantially mutually offset, with respect to one another, such that the two tubes are held in two contact areas per period of sinusoids.

The sinusoids of the respective tubes of two consecutive rows are preferably substantially in phase opposition, while the sinusoids of the same row are in phase.

According to another optional characteristic of the present invention, the contact areas of the respective tubes of consecutive rows are substantially inscribed within a plane perpendicular to the rows.

Advantageously, the spacing between the rows is substantially constant.

According to another advantageous characteristic of the invention, at least a part of the outer surface of the tubes, comprising the abovementioned contact areas, is coated with a layer of adhesive in order to form means for holding the tubes.

In one preferred embodiment of the present invention, the outer surfaces of the tubes carry a material made adhesive by a vulcanizing treatment, thus forming the abovementioned layer of adhesive.

In one more elaborate embodiment of the invention, the holding means further include a plurality of rods substantially perpendicular to the rows and each installed between the respective sinusoids of consecutive rows, in order to hold the tubes of the consecutive rows spaced substantially apart.

BRIEF DESCRIPTION OF THE DRAWINGS

Other advantages and characteristics of the present invention will emerge on reading the detailed description below and the attached drawings, on which:

FIG. 3A represents the tubes of a heat exchanger according to the present invention, shaped into lines of substantially sinusoidal shape, FIG. 3B represents the tubes of FIG. 3A, in a front view, FIG. 3C is a view along the section C—C of FIG. 3B, in the sectional plane of the tubes, FIG. 3D is a view along the section D—D of FIG. 3B, FIG. 3E is a side view of the tubes of FIG. 3A, FIG. 4A represents the tubes of a heat exchanger, which are fitted with parallel rods, FIG. 4B is a top view of the tubes of FIG. 4A, and FIG. 4C is a side view of the tubes of FIG. 4A.

DETAILED DESCRIPTION OF PREFERRED EMBODIMENTS

The attached drawings in essence contain elements of a certain character. They could not only serve to give a better understanding of the present invention but also contribute to its definition, as the case may be.

Figure 1:
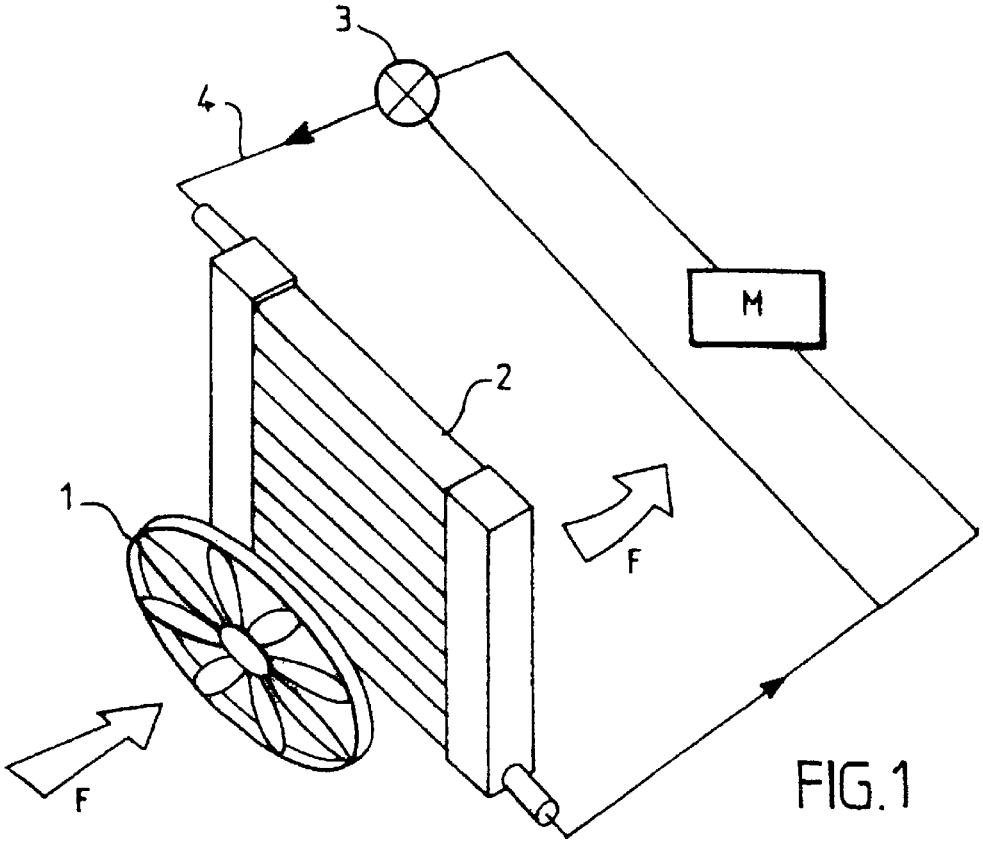
FIG. 1 diagrammatically represents a partial view of a device for cooling the engine of a motor vehicle in the example described.

FIG. 1 is first of all used as reference, in order to describe a device for cooling a motor-vehicle engine.

Such a device includes, in a way, which is itself known, a motor-driven fan unit 1 equipped with a plurality of blades. The motor-driven fan unit 1 is usually placed behind the vehicle grille (not represented). A heat exchanger according to the invention is interposed in an airflow (arrows F) which the rotation of the blades of the motor-driven fan unit 1 or else the movement of the vehicle itself produces. In practice, the heat exchanger is fed with the engine-cooling liquid, usually under the control of a thermostatic valve 3. Arranging such a valve in the circuit of the cooling liquid 4 generally makes it possible to obtain satisfactory efficiency of the engine M when it is started from cold, by cutting off the supply to the radiator.

Figure 2:
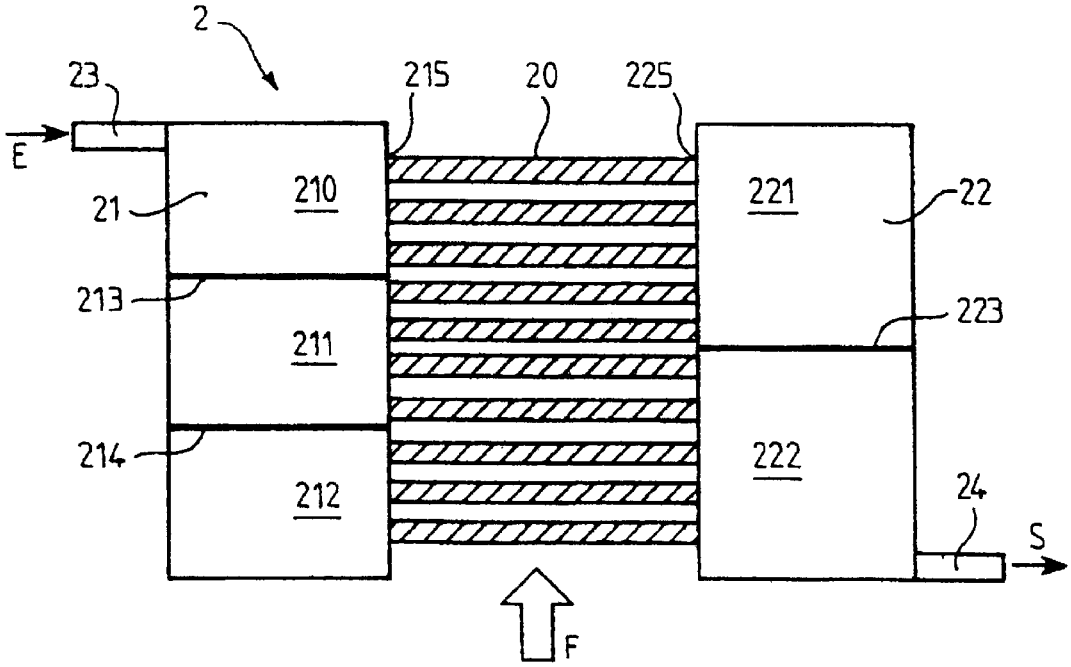
FIG. 2 represents a diagrammatic view of a heat exchanger, in particular of a cooling radiator 2 of a device represented in FIG. 1.

FIG. 2 is now used as reference in order to describe the structure of the heat exchanger 2 (cooling radiator, in the example). This heat exchanger includes flexible tubes 20 (represented by hatching in FIG. 2), which are generally produced from a plastic, which communicate via their extremities with two manifolds 21 and 22. In fact the manifolds are fitted with apertures 215 and 225 tightly accommodating the extremities of the tubes 20. In practice, the manifolds include collector plates equipped with apertures 215 and 225 and which thus form means for holding the tubes, in particular at their extremities.

The manifolds 21 and 22 usually feature compartments 210, 211, 212 and 221, 222, separated by partitions 213, 214 and 223, respectively, in order to define a path for the abovementioned heat-exchange fluid (cooling liquid in the example described), between an inlet C (arrow E) which communicates with an intake pipe 23 and an exit (arrow S) which communicates with a discharge pipe 24. In the example represented in FIG. 2, the manifolds include five compartments in all, and the heat-exchange fluid performs three "outward" and two "return" journeys in all from the manifold 21 to the manifold 22.

The paths for the fluid between the two manifolds 21 and 22 are then provided by the tubes 20, in which the fluid circulates. Hence, the tubes interact thermally with the airflow F. However, in order to optimize the heat exchange between the tubes 20, on the one hand, and the airflow F, on the other hand, it is necessary to keep the tubes spaced substantially apart from one another in order to create interstices between them.

FIGS. 3A to 3E are used as reference then in order to describe the set of tubes of a heat exchanger according to a first embodiment of the present invention.

According to one general characteristic of the invention, the tubes 20 of the exchanger are arranged in rows 20A, horizontal in the example described (FIG. 3E). These rows are substantially parallel to each other and spaced, in the example described, by a distance corresponding substantially to one tube thickness 20, such that the various rows are substantially adjacent in pairs of respective tubes of two consecutive rows, substantially in contact with one another.

By referring to FIG. 3A, it is apparent that the tubes overall exhibit generally substantially sinusoidal shapes. The tubes 211, 212 of the same row 20A have their sinusoid substantially in phase. Referring to FIG. 3B, it is apparent that two tubes 211, 212 in contact, of two consecutive, respective rows, are in phase opposition and are in contact on areas 210 corresponding to nodes of two sinusoids.

FIG. 3C represents a sectional view (sectional plane of the tubes) of the nodes of the abovementioned sinusoids. The tubes of the same row 20A are substantially spaced from each other, since the sinusoids of a single row are in phase, whereas the tubes of two consecutive rows are in contact in the region of the areas 210 (nodes of the sinusoids).

FIG. 3D is a sectional view (sectional plane of the tubes) of the troughs which the sinusoids of the tubes of the consecutive rows form. A separation then appears between two tubes of two respective consecutive rows, since the sinusoids of the two tubes are in phase opposition from one row 20A to another, the rows being consecutive.

As FIG. 3C shows, the areas of contact 210 between the tubes of consecutive rows are inscribed within substantially horizontal planes, whereas the rows 20A are arranged in substantially vertical planes. Hence, the areas of contact 210 of the respective tubes of consecutive rows are substantially inscribed within planes perpendicular to the rows 20A.

The tubes are preferably produced from a plastic made adhesive by a heat treatment. Hence, after heat treatment, the tubes are joined mechanically to one another by bonding, in their contact areas 210. In a variant, provision can be made to coat the outer surfaces of the tubes with a material exhibiting such a property, or even with a layer of adhesive so as to form the abovementioned holding means. In particular, spots of adhesive arranged on the contact areas 210 are sufficient to hold the tubes in rows 20A and substantially fixed with respect to one another. It should be noted that the apertures of the manifolds are themselves arranged in rows and columns so as to keep the extremities of the tubes in rows from the outset.

FIGS. 4A to 4C are now used as reference in order to describe the configuration of the tubes of a heat exchanger according to a second embodiment of the present invention.

As in the first embodiment described above, the tubes of a single row 20A form sinusoids substantially in phase, whereas the tubes of two consecutive rows form sinusoids in phase opposition. In this embodiment, rods 213, substantially parallel to each other and perpendicular to the rows 20A are furthermore provided. Each of these rods is inserted into the troughs which the sinusoids of the tubes of consecutive rows form, as FIG. 4B shows. Such rods 213 thus make it possible to hold the tubes spaced substantially apart in the consecutive rows. Consequently, it is not necessary here to provide an adhesive coating on the tubes, in particular on the contact areas 210. However, provision may further be made to give the outer surfaces of the tubes and, in particular, the outer surfaces of the rods, a layer of adhesive or a coating rendered adhesive by heat treatment, for example by vulcanizing, in order to reinforce the holding of the tubes in interleaved row [sic], as represented in FIGS. 3A and 4A.

Thus, the spacing between the tubes, in particular in the troughs of sinusoids, lets through the airflow F into the exchanger, while perturbing the flow F, advantageously. Moreover, the flexible tubes of the exchanger are, in general, of small diameter, typically about 1 to 4 mm and have a wall thickness close to 0.2 mm. It is then desirable to hold the tubes in a substantially rigid structure via their configuration in sinusoids described above, with a view to protecting them against the stresses of use (vibration, aging of the plastic, pressure of the heat-exchange fluid, etc.) which tends to make them fragile. Another advantage which the present invention confers then consists in that the tubes are held fixedly with respect to one another.

The period of the sinusoids preferably lies within a range of 40 to 80 mm and the amplitude, with respect to a general tube axis, lies between one tube half-diameter and two tube diameters. Referring especially to FIG. 3A, the extremities of the tubes are contiguous and flat over a length of about 5 to 25 mm, in order to be able to be connected to the manifolds, whereas the total length of the tubes is of the order of 500 mm, for example.

Clearly, the present invention is not limited to the embodiment described above by way of example. It extends to other variants.

Thus it will be understood that the sinusoids of the tubes of a single row are not necessarily in phase. In a variant, it may be envisaged, in fact, to arrange the tubes of a single row spaced sufficiently apart, whereas the phases between their sinusoid are substantially random.

Furthermore, the adjacent tubes of two consecutive rows are not necessarily in phase opposition. In fact it is sufficient to phase-shift the two sinusoids in order to allow an airflow to penetrate between the tubes. However, the configuration of two sinusoids in phase opposition allows maximum penetration by the air-flow through the troughs which they form.

In the example described above, the rows are substantially horizontal, whereas the contact areas 210 are arranged substantially in vertical planes. More generally, these planes are not necessarily perpendicular to the rows, in particular if the tubes which are adjacent between consecutive rows are offset laterally from one row to another.

The abovementioned means for holding the tubes (film of adhesive, coating rendered adhesive by heat treatment, spacer rods 213) are described above by way of example. Other holding means may be envisaged.

Furthermore, in the example represented in FIG. 2, the exchanger 2 includes two manifolds. In a variant, only one manifold may be provided, fitted with apertures into which the extremities of the tubes are inserted, while each tube exhibits a "U" shape, the two branches of which are made to undulate and are inscribed within the same row, or else interlaced, where each "U" branch is inscribed within a separate row.

Finally, the heat exchanger described above by way of example is intended to operate as a cooling radiator of a motor vehicle. In a variant, this heat exchanger may be designed as a heating radiator housed in a hot-air branch of a heating, ventilation and/or air conditioning installation for the passenger compartment of the vehicle, or else as an evaporator of an air-conditioning loop for this installation, or otherwise. Furthermore, the fluid passing through the heat exchanger (airflow F in the example described above) may be of a different type, for example oil, especially for an application of the heat exchanger as a radiator for cooling the engine oil.

What is claimed is:

1. Heat exchanger, especially for a motor-vehicle engine cooling installation, comprising a plurality of separately-formed tubes (20) produced from a substantially flexible material and intended to carry a heat-exchange fluid suitable for interacting with a flow of fluid (F) passing through the exchanger, and a fastening system for holding the tubes in substantially parallel rows (20A), and wherein the tubes (20) are shaped so as to extend along substantially sinusoidal lines, while sinusoids of at least two tubes (211, 212) in contact at contact areas, of at least two respective consecutive rows defining at least two columns, are substantially offset in phase with respect to one another, such that the two tubes are held in two contact areas (210) per sinusoid period, wherein said rows and columns define an array of said tubes.

2. Exchanger according to claim 1, wherein the sinusoids of the respective tubes (211, 212) of two consecutive rows are substantially in phase opposition, while the sinusoids of the same row (20A) are in phase.

3. Exchanger according to claim 2, wherein the contact areas (210) of the respective tubes of consecutive rows are substantially inscribed within a plane perpendicular to the rows.

4. Exchanger according to claim 3, wherein spacing between the rows (20A) is substantially constant.

5. Exchanger according to claim 4, wherein at least a part of an outer surface of the tubes, comprising said contact areas (210), is coated with a layer of adhesive in order to form said fastening system for holding the tubes.

6. Exchanger according to claim 5, wherein the outer surfaces of the tubes (20) carry a material made by a heat treatment.

7. Exchanger according to claim 1, wherein the fastening system further include a plurality of rods (213) substantially perpendicular to the rows (20A) and each said rods installed between the respective sinusoids of consecutive rows, in order to hold the tubes (211, 212) of the consecutive rows spaced substantially apart.

8. Exchanger according to claim 1, further comprising at least one manifold (21, 22) equipped with apertures (215, 225) each communicating with one extremity of at least one of said tubes, and configured to accommodate the extremities of the tubes tightly, forming means for holding the extremities of the tubes.

9. Exchanger according to claim 8, wherein the period of the sinusoids lies between 40 and 80 mm.

10. Exchanger according to claim 9, wherein the amplitude of the sinusoids, with respect to a general tube axis (20), lies between one tube half-diameter and two tube diameters.

11. Exchanger according to claim 10, wherein the extremities of the tubes (20) are contiguous and flat over a length of about 5 to 25 mm.

* * * * *